US009027810B1

(12) United States Patent
Piersol

(10) Patent No.: US 9,027,810 B1
(45) Date of Patent: May 12, 2015

(54) METHOD OF PRODUCING A BALLISTIC RESISTANT ARTICLE

(76) Inventor: John C. Piersol, Belpre, OH (US)

( * ) Notice: Subject to any disclaimer, the term of this patent is extended or adjusted under 35 U.S.C. 154(b) by 1420 days.

(21) Appl. No.: 12/205,789

(22) Filed: Sep. 5, 2008

(51) Int. Cl.
*A45C 15/00* (2006.01)
*A45C 13/02* (2006.01)

(52) U.S. Cl.
CPC ..... *A45C 13/02* (2013.01)

(58) Field of Classification Search
CPC ..... A45C 13/02; A45C 5/02; A45C 13/36; F41H 5/08
USPC ..... 224/576, 577, 153, 645, 650; 89/36.01–36.07; 190/101, 127
See application file for complete search history.

(56) References Cited

U.S. PATENT DOCUMENTS

| | | | | | |
|---|---|---|---|---|---|
| 1,666,878 | A * | 4/1928 | Johnson | 190/111 |
| 3,762,345 | A * | 10/1973 | Sgariglia, Jr. | 109/22 |
| 4,475,247 | A * | 10/1984 | Lee | 2/2.5 |
| 4,506,769 | A * | 3/1985 | Franco et al. | 190/108 |
| 4,546,863 | A * | 10/1985 | Kaufman | 190/102 |
| 4,569,082 | A * | 2/1986 | Ainsworth et al. | 383/3 |
| 4,774,724 | A * | 10/1988 | Sacks | 2/2.5 |
| 4,830,245 | A | 5/1989 | Arakaki | |
| 5,031,733 | A | 7/1991 | Chang | |
| 5,115,893 | A * | 5/1992 | Terkildsen | 190/11 |
| 5,149,203 | A * | 9/1992 | Sacks | 383/111 |
| 5,370,113 | A * | 12/1994 | Parsons | 128/205.22 |
| 6,161,738 | A * | 12/2000 | Norris | 224/153 |
| 6,210,037 | B1 * | 4/2001 | Brandon, Jr. | 383/111 |
| 6,419,132 | B1 | 7/2002 | Reed et al. | |
| 6,681,400 | B1 | 1/2004 | Mills | |
| 6,685,071 | B2 | 2/2004 | Prather | |
| 7,146,899 | B2 * | 12/2006 | Imblum et al. | 89/36.01 |
| 7,441,278 | B2 * | 10/2008 | Blakeley | 2/2.5 |
| 7,490,358 | B1 * | 2/2009 | Beck | 2/2.5 |
| 2003/0132260 | A1 * | 7/2003 | Prather | 224/576 |
| 2004/0163913 | A1 * | 8/2004 | Tschudy | 190/111 |
| 2005/0242093 | A1 * | 11/2005 | Sharpe et al. | 220/62.11 |

FOREIGN PATENT DOCUMENTS

| | | |
|---|---|---|
| WO | WO01/03531 | 1/2001 |

* cited by examiner

*Primary Examiner* — Adam Waggenspack
(74) *Attorney, Agent, or Firm* — Michael I. Kroll

(57) ABSTRACT

A method for a user to produce a ballistic resistant carriable article through the user a) providing a desired article to be used as a container for at least one sheet of ballistic resistant material that is formable to the selected article, b) shaping said material by cutting or folding to the desired article and attaching through fastener to the interior surface of the article. The carriable article is preferably taken from the group of purse, attaché case, backpack and carry-on luggage. The at least one sheet of ballistic resistant material is attached to the interior surface of the article with fastener means, preferably taken from the group of double back tape, VELCRO®, snaps and glue.

3 Claims, 9 Drawing Sheets

METHOD OF PRODUCING A BALLISTIC RESISTANT ARTICLE

BACKGROUND OF THE INVENTION

1. Field of the Invention

The present invention relates generally to armor and, more specifically, to a method for producing a ballistic resistant carriable article. The desired article includes at least one sheet of ballistic resistant material that is formable to the selected article through shaping said material by cutting or folding to the desired article and attaching through fastener means to the interior surface of the article.

The carriable article is preferably taken from the group of purse, attaché case, backpack and carry-on luggage serving as receptacle for attachment of at least one sheet of ballistic resistant material to the interior surface of the selected article through fastener means preferably taken from the group of double back tape, VELCRO®, snaps and glue.

2. Description of the Prior Art

There are other ballistic resistant devices designed for personal protection. Typical of these is U.S. Pat. No. 3,762,345 issued to Sgariglia, Jr. on Oct. 2, 1973.

Another patent was issued to Kaufman on Oct. 15, 1985 as U.S. Pat. No. 4,546,863. Yet another U.S. Pat. No. 4,830,245 was issued to Arakaki on May 16, 1989 and still yet another was issued on Jul. 16, 1991 to Chang as U.S. Pat. No. 5,031,733.

Another patent was issued to Norris on Dec. 19, 2000 as U.S. Pat. No. 6,161,738. Yet another U.S. Pat. No. 6,419,132 was issued to Reed et al. on Jul. 16, 2002. Another was issued to Mills on Jan. 27, 2004 as U.S. Pat. No. 6,681,400 and still yet another was issued on Feb. 3, 2004 to Prather as U.S. Pat. No. 6,685,071.

Another patent was issued to Imblum et al. on Dec. 12, 2006 as U.S. Pat. No. 7,146,899. An International Publication No. WO 01/03531 was published on Jan. 18, 2001 to Norris.

Disclosed is an attaché case that can be used in the conventional manner for transporting personal effects but which additionally functions as an armor shield to protect a user from projectiles fired by handguns. At a time of use an armor assembly is expanded from a compact nested arrangement into an expanded configuration that increases the surface area of the protective shield.

An attaché case constructed to serve as a protective shield against bullet fired from handguns, the case having separate and relatively movable top and bottom sections with the top section including a flexible sidewall with a pouch holding an armor plate releasably attached to the exterior side of the sidewall. A pair of hand straps are attached to the bottom section of the case.

A backpack carrier has a lightweight metal frame embedded in KEVLAR. The KEVLAR is preferably wrapped to form a plurality of layers over the metal frame and the plural layers are held together by the epoxy portion of the KEVLAR which integrally binds laminations of woven carbon-based fabric. The carrier is shaped to provide a substantially bulletproof shield and may also be used as a rifle support by placing the barrel of a rifle in a V-shaped notch provided in an upper portion of the shield.

A suitcase with multiple hinged joints which allow it to unfold into a single plane and designed to be worn as a vest includes a first plate member, a second plate member and an elongated sheet member. The first plate member has a pair of two opposed edges, a first two opposed edges and a second two opposed edges. Each of the first two opposed edges has two straps. One edge of the second two opposed edges has a handle. The second plate member has a pair of two opposed edges, a first two opposed edges and a second two opposed edges. Each of the first two opposed edges has two straps, which are designed to engage and secure with the straps of the first two edges of the first plate member. One edge of the second two opposed edges of the second plate member has a handle which is aligned with the handle of the first plate member. The sheet member has two long edges and two short edges, the two long edges respectively connect the remaining edges of the second two opposed edges of the first and the second plate members.

A combination container for transporting articles which can concurrently be used as a ballistic shield from high speed projectiles such as bullets and/or shrapnel. The container, which can be a backpack, purse, computer carrying case, or similar bag style device, features a forward wall and a rear wall each having forming a compartment therebetween and at least one ballistic shield, attachable to one or both of the forward wall and said rear wall. Upper flaps and lower flaps attached to the bag afford deployable additional protection from attached ballistic shields. A handle provides a means for elevating the deployed elongated flaps and attached bag in front of the user to provide a large area of protection from such high speed projectiles.

A backpack engagable so as to be worn and including an attached covering having load-bearing armor and mounted for movement between a stored condition of the armor toward the backpack and a deployed condition of the armor away from and opposing the backpack.

There is provided dual use body armor that can be alternately used either as a hand held shield which can be concealed in a standard bag (such as an attaché case) or worn as an armor vest, and which can be quickly converted from one use to the other. For this reason the shield would normally be of an approximately rectangular shape. The exact shape may be varied in order to fit in different types of carry bag, or to better conform (for the purpose of comfort or protection) to the shape of the body when unstowed or deployed and worn as a vest. When used as a vest, the invention is preferably comprised of two or more armor panels that unfold or deploy to protect an area of the front and back, and preferably also the side and lower abdomen, of the torso. The front armor panel, back armor panel, side armor panels, and lower abdomen armor panel, are all located on the body by means of a support system. When stowed, the side and lower abdomen armor panels are shaped to fit closely together as in a jigsaw puzzle as the middle layer of a three layer structure. The armor is designed to be unstowed and put on as a vest with no need for fastening or adjustment.

A container for transporting articles that transforms into a ballistic protection unit includes a bag and a detachable panel. The bag includes a first compartment for containment of at least one piece of ballistic shield material. The detachable panel also contains at least one piece of ballistic shield material and is coupled to the bag by at least a first strap. The detachable panel is detachably coupled to the bag. During use, the user may detach the detachable panel from the bag and the bag may be placed over a shoulder of the user, protecting the user from high speed projectiles.

A bullet-resistant defensive device is disclosed made up of layers of bullet resistant material layered together and connected along their peripheral edge on a frame to form a planar shield. The shield so formed works such that a bullet striking the shield causes the layered bullet resistant material to flex thereby dissipating the force of the bullet, the material when it stretches transfers the force of the bullet from a shear mode to a tensile mode. One preferred embodiment incorporates the invention into a clipboard box for use by police officers for protecting against head, neck and hand wounds from handguns fired at close range from vehicles. The hand-held, bullet resistant clipboard box holds documents and writing implements, and the bullet-resistant material is located within the clipboard box interior cavity and configured for catching a fired bullet before it can pass through the entire clipboard.

A combination container for transporting articles which can concurrently be used as a ballistic shield from high speed projectiles such as bullets and/or shrapnel. The container, which can be a backpack, purse, computer carrying case, or similar bag style device, features a forward wall and a rear wall each having a compartment therebetween and at least one ballistic shield, attachable to one or both of the forward wall and said rear wall. Upper flaps and lower flaps attached to the bag afford deployable additional protection from attached ballistic shields. A handle provides a means for elevating the deployed elongated flaps and attached bag in front of the user to provide a large area of protection from such high speed projectiles.

While these ballistic resistant articles may be suitable for the purposes for which they were designed, they would not be as suitable for the purposes of the present invention, as hereinafter described.

SUMMARY OF THE PRESENT INVENTION

A primary object of the present invention is to provide a method for a user to selectively create a carriable ballistic resistant article.

Another object of the present invention is to provide a ballistic resistant article comprising a user selected carriable article lined with a ballistic resistant material.

Yet another object of the present invention is to provide a ballistic resistant article comprising at least one sheet of ballistic resistant material.

An additional object of the present invention is to provide a ballistic resistant article wherein the at least one sheet is formable to a desired shape by cutting.

A further object of the present invention is to provide a ballistic resistant article wherein the ballistic resistant material is pliable and foldable to conform to the interior wall of the article selected to be ballistically resistant.

Another object of the present invention is to provide a ballistic resistant article comprising a plurality of ballistic resistant sheets.

Still yet another object of the present invention is to provide a ballistic resistant article having fasteners for attachment to a user selected carriable article.

Another object of the present invention is to provide a ballistic resistant article wherein the user selected article is taken from the group of purse, attaché case, backpack and carry on luggage.

Yet another object of the present invention is to provide a ballistic resistant article using at least one fastener for attachment of the ballistic resistant material to the selected article with the fastener selected from the group of double back tape, VELCRO®, snaps and glue.

Still yet another object of the present invention is to provide a ballistic resistant article that a user can employ as a shield when confronted with an armed assailant.

Another object of the present invention is to provide a ballistic resistant article lined with a concealed ballistic resistant material.

Additional objects of the present invention will appear as the description proceeds.

The present invention overcomes the shortcomings of the prior art by providing a method for a user to produce a ballistic resistant carriable article through the user a) providing a desired article to be used as a container for at least one sheet of ballistic resistant material that is formable to the selected article, b) shaping said material by cutting or folding to the desired article and attaching through fastener to the interior surface of the article. The carriable article is preferably taken from the group of purse, attaché case, backpack and carry-on luggage. The at least one sheet of ballistic resistant material is attached to the interior surface of the article with fastener means, preferably taken from the group of double back tape, VELCRO®, snaps and glue.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
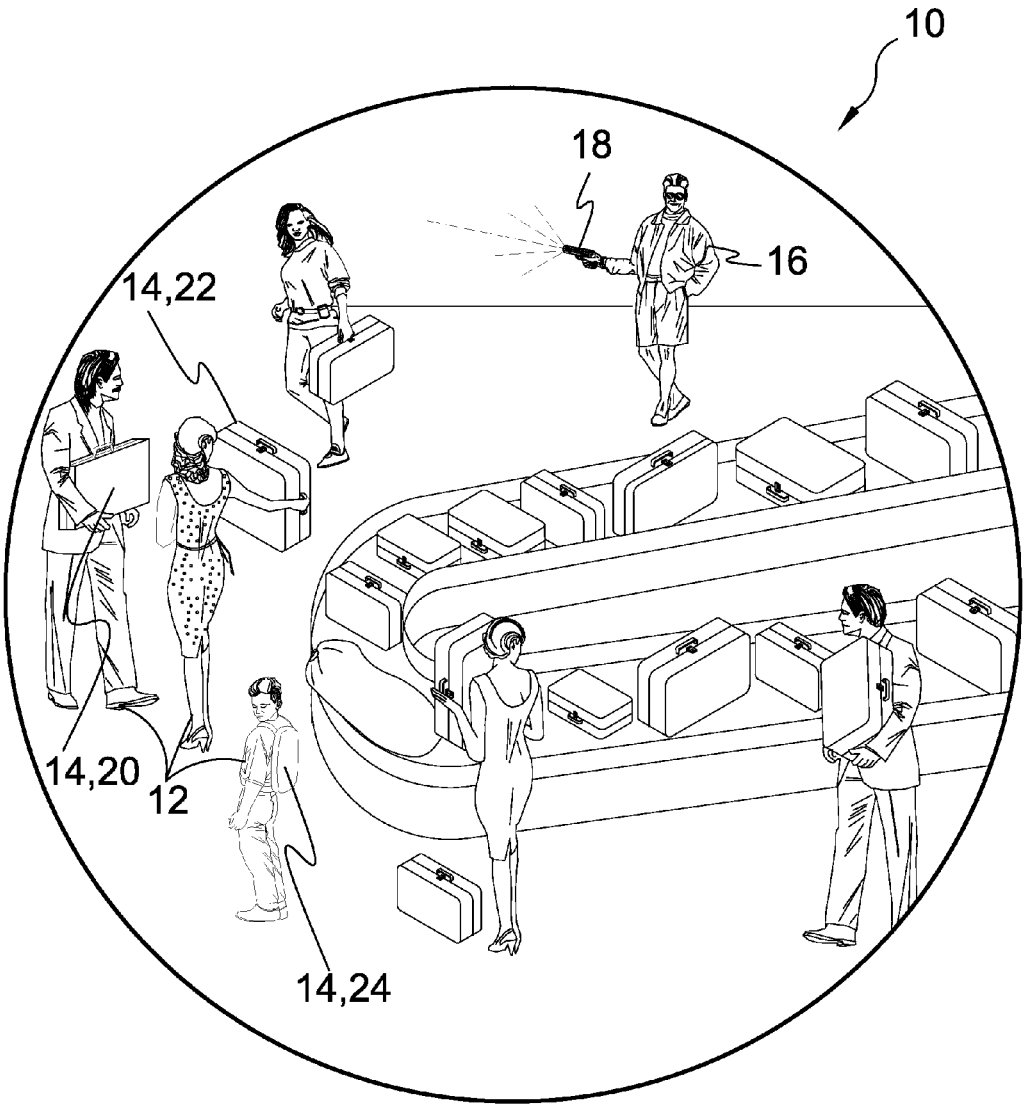
FIG. 1 is an illustrative view of the present invention in use.

Turning now descriptively to the drawings, in which similar reference characters denote similar elements throughout the several views, the figures illustrate the Method of Producing a Ballistic Resistant Article of the present invention. With regard to the reference numerals used, the following numbering is used throughout the various drawing figures.

10 Method of Producing a Ballistic Resistant Article of the present invention

12 user

14 article
16 gunman
18 weapon
20 briefcase
22 suitcase
24 backpack
25 handbag
26 ballistic resistant material
28 fastener element
30 hook and loop fastener
32 double sided tape
34 button
36 snap
38 first sheet of ballistic resistant material
40 second sheet of ballistic resistant material

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention in use. The present invention 10 is a user 12 selected article 14 lined with a ballistic resistant material that can be used as a shield while escaping from a hostile situation. The present invention 10 provides at least one sheet of pliable ballistic resistant material having fasteners for attaching the formable ballistic resistant material to the selected article 14. People not carrying ballistic resistant articles are much more likely to get injured in hostile situations. Shown is a gunman 16 firing a weapon 18 at users protected by ballistic resistant articles 14 including a briefcase 20, a suitcase 22 and a backpack 24.

Figure 2:
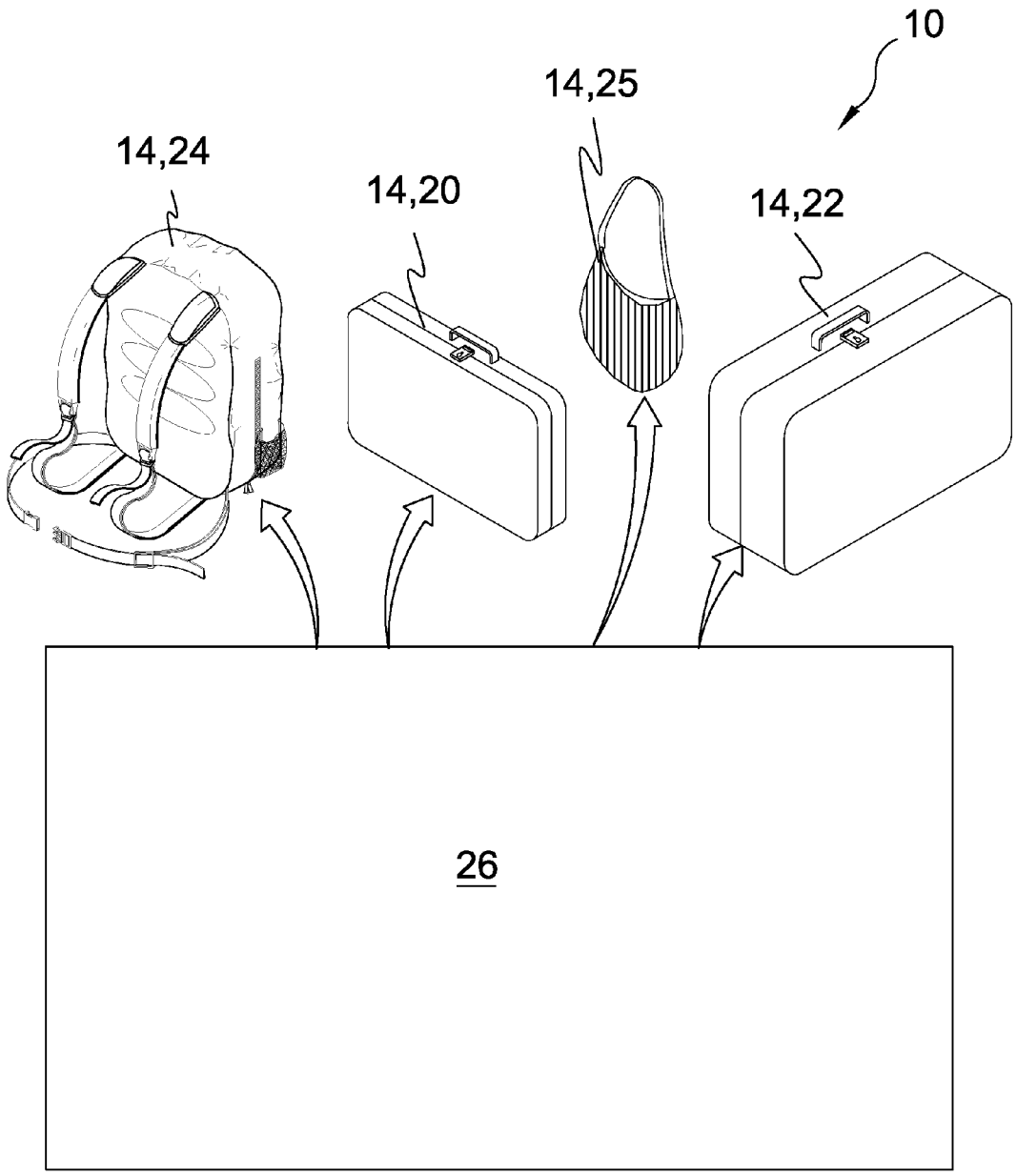
FIG. 2 is an illustrative view of the present invention.

FIG. 2 is an illustrative view of the present invention 10. The present invention 10 is a method whereby a user can create a ballistic resistant article 14 by selecting an article 14 and attaching the ballistic resistant material 26 thereto using appropriate fastener elements 28. The ballistic resistant material 26 can be cut to the article shape and fastened to the interior thereby providing the user with a concealed defensive mechanism to aid the user in escaping from a hostile situation involving small arms fire.

Figure 3:
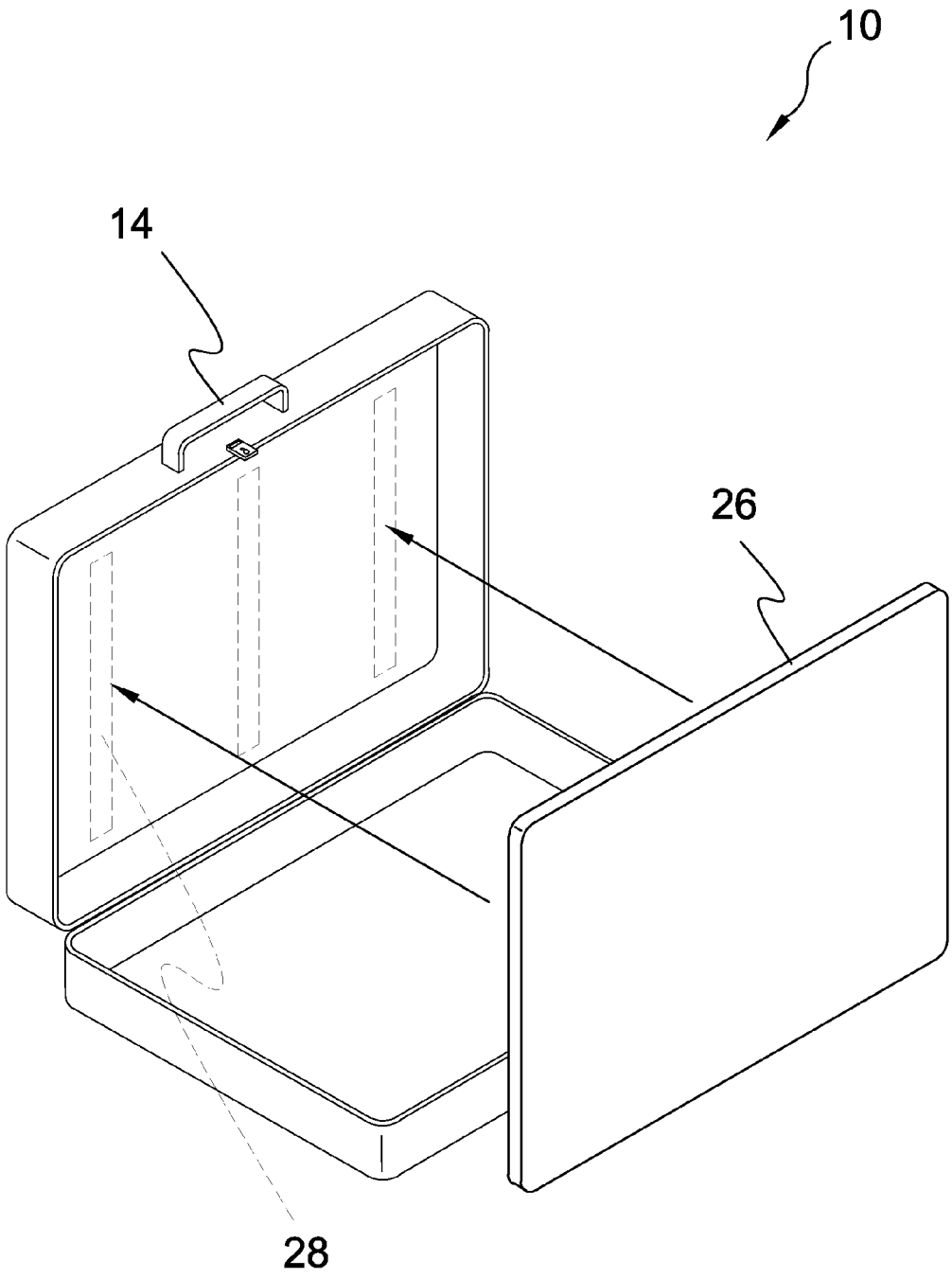
FIG. 3 is an illustrative view of the method to produce a ballistic resistant article.

FIG. 3 is an illustrative view of the method to produce a ballistic resistant article 14. Shown is the present invention 10, a ballistic resistant article 14 comprising a single KEVLAR® sheet 26 to be trimmed and mounted to fit a hand carried article 14 such as a backpack, attaché case, purse and carry-on luggage. KEVLAR is made from an aramid fiber and generically known as poly-paraphenylene terepthalamide.

Figure 4:
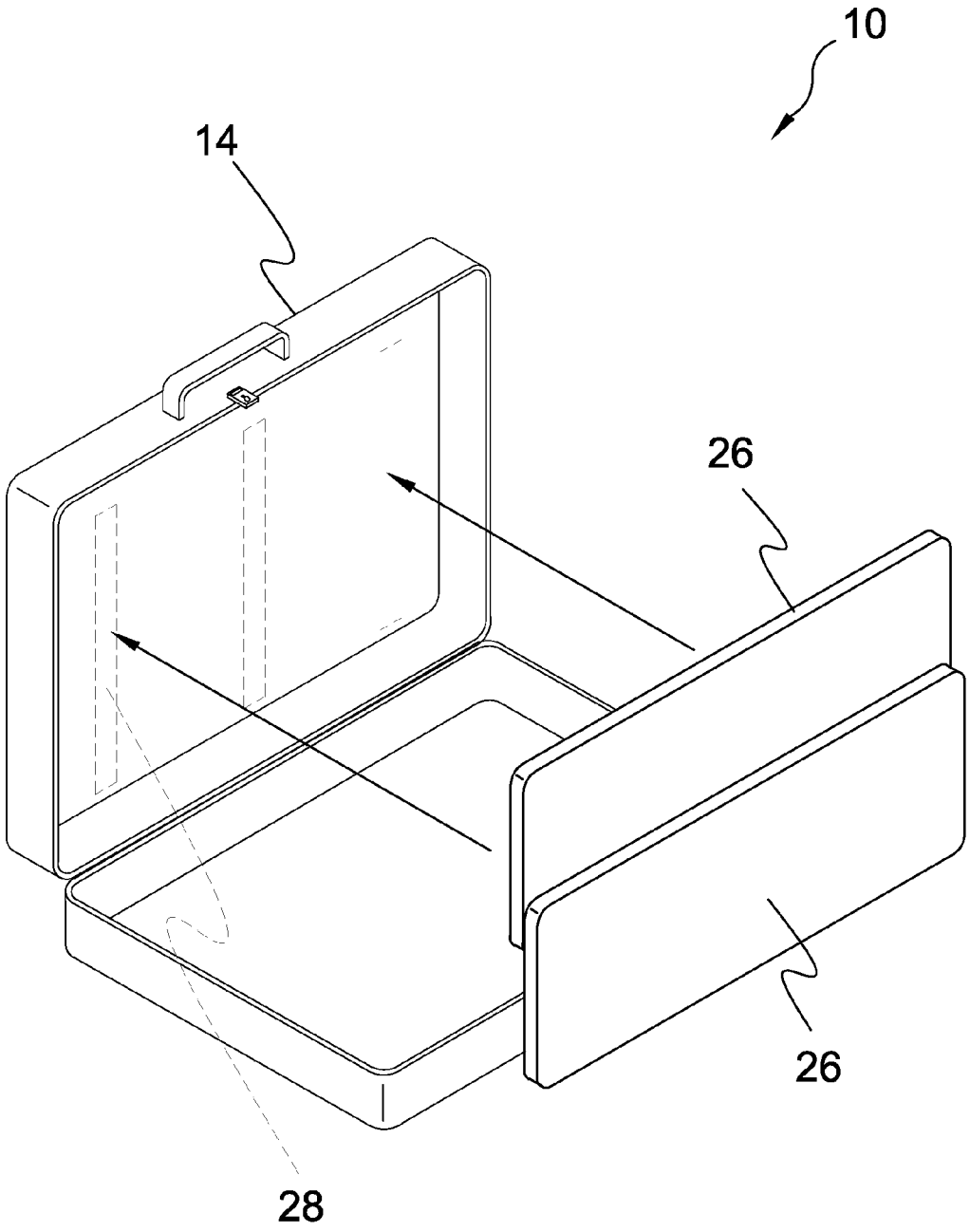
FIG. 4 is an illustrative view of the method of the present invention.

FIG. 4 is an illustrative view of the method of the present invention 10. Shown is the present invention comprising two sheets of ballistic resistant material 26, such as KEVLAR®, fastened together using an appropriate fastener and sized to fit the user selected article 14, which will be attached to the interior housing structure by fastener 28 producing a ballistic resistant article 14.

As clearly illustrated in FIG. 4, the two sheets of ballistic resistant material 26 are partially overlapping.

Figure 5:
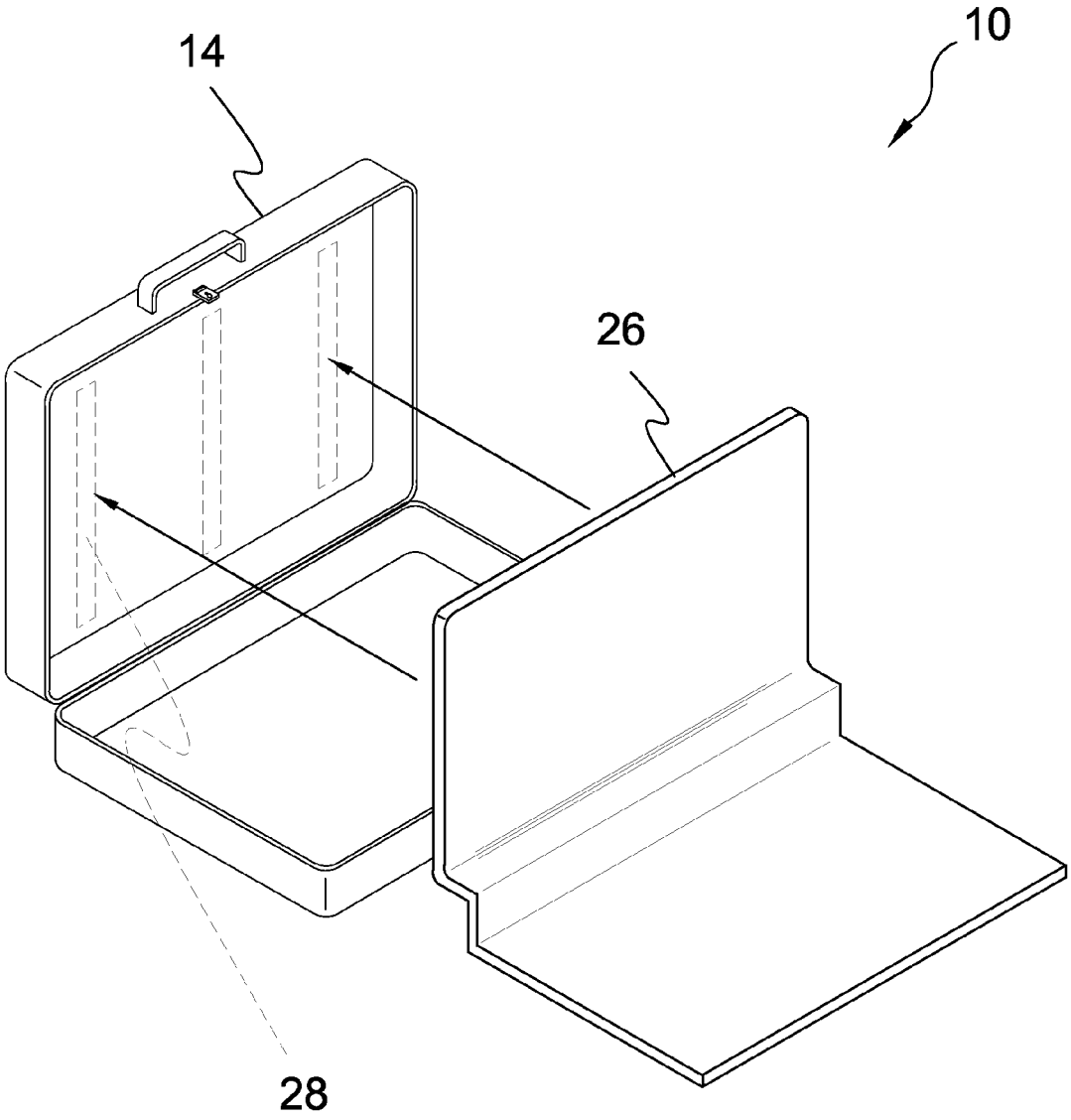
FIG. 5 is an illustrative view of the method of the present invention.

FIG. 5 is an illustrative view of the method of the present invention 10. Shown is a single sheet of ballistic resistant material 26 pliably formed to fit into the interior housing of a user selected article 14 resulting in a ballistically resistant article 14 that can serve to protect the user in escaping from a hostile environment. The pliable sheet 26 can be cut to a desired shape and appropriately fastened to the interior of the selected article 14 which preferable is a hand carried article such as a backpack, attaché case, purse and carry-on luggage.

Figure 6:
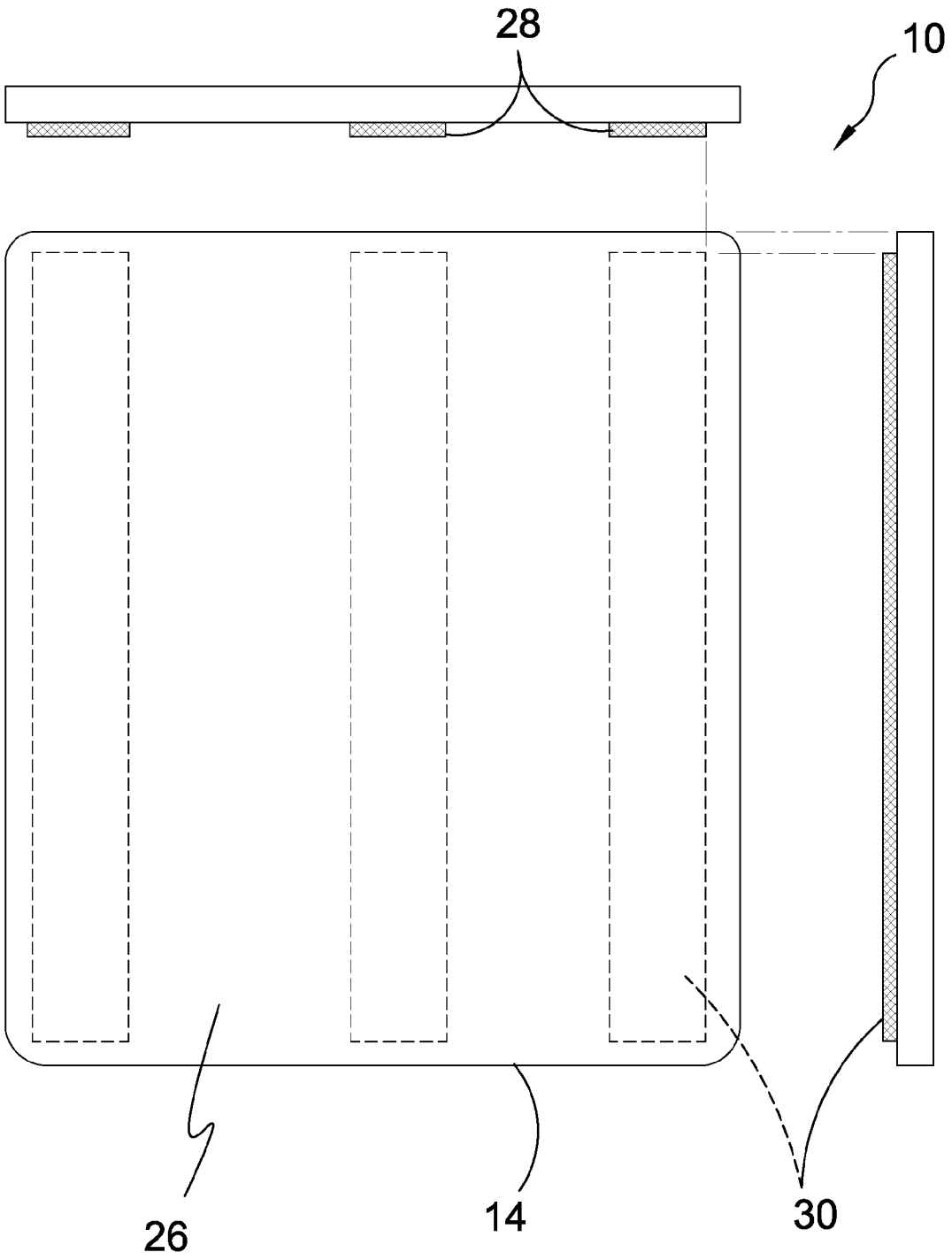
FIG. 6 is an illustrative view of one type of fastener employed to attach the ballistic resistant material to a user selected carriable article.

FIG. 6 is an illustrative view of one type of fastener element 28 employed to attach the ballistic resistant material 26 to a user selected carriable article 14. The method of the present invention 10 provides for attachment fasteners 28 positioned between the article 14 to be lined and the ballistic resistant material 26 such as double back tape, hook and loop 30, snaps and glue. The article 14 to be lined includes backpack, attaché case, purse and carrion luggage.

Figure 7:
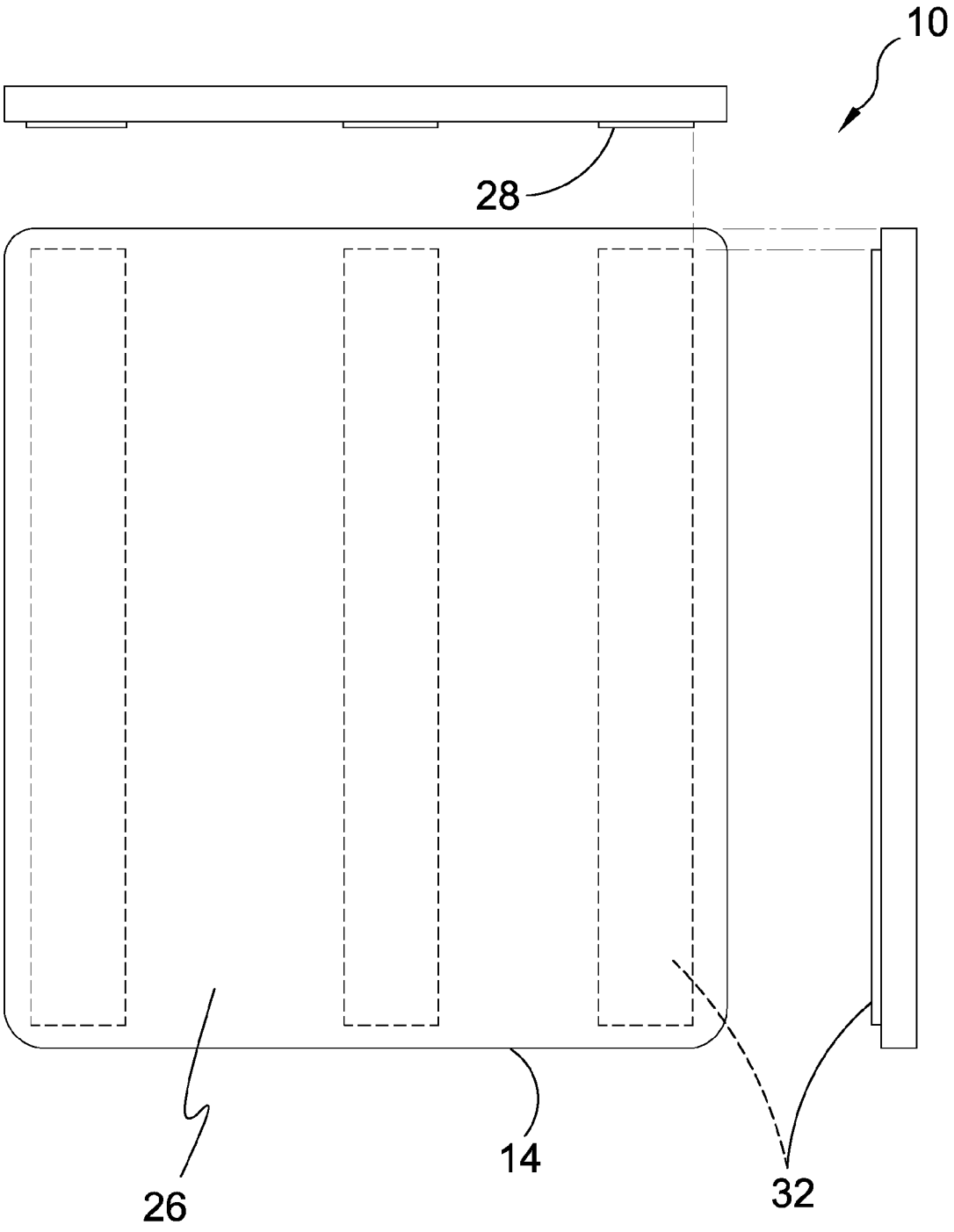
FIG. 7 is an illustrative view of another type of fastener employed to attach the ballistic resistant material to a user selected carriable article.

FIG. 7 is an illustrative view of another type of fastener 28 employed to attach the ballistic resistant material 26 to a user selected carriable article 14. The method of the present invention 10 provides for attachment fasteners 28 positioned between the article 14 to be lined and the ballistic resistant material 26 such as double back tape 32, VELCRO® (hook and loop fastener strips), snaps and glue. The article 14 to be lined including backpack, attaché case, purse and carry-on luggage.

Figure 8:
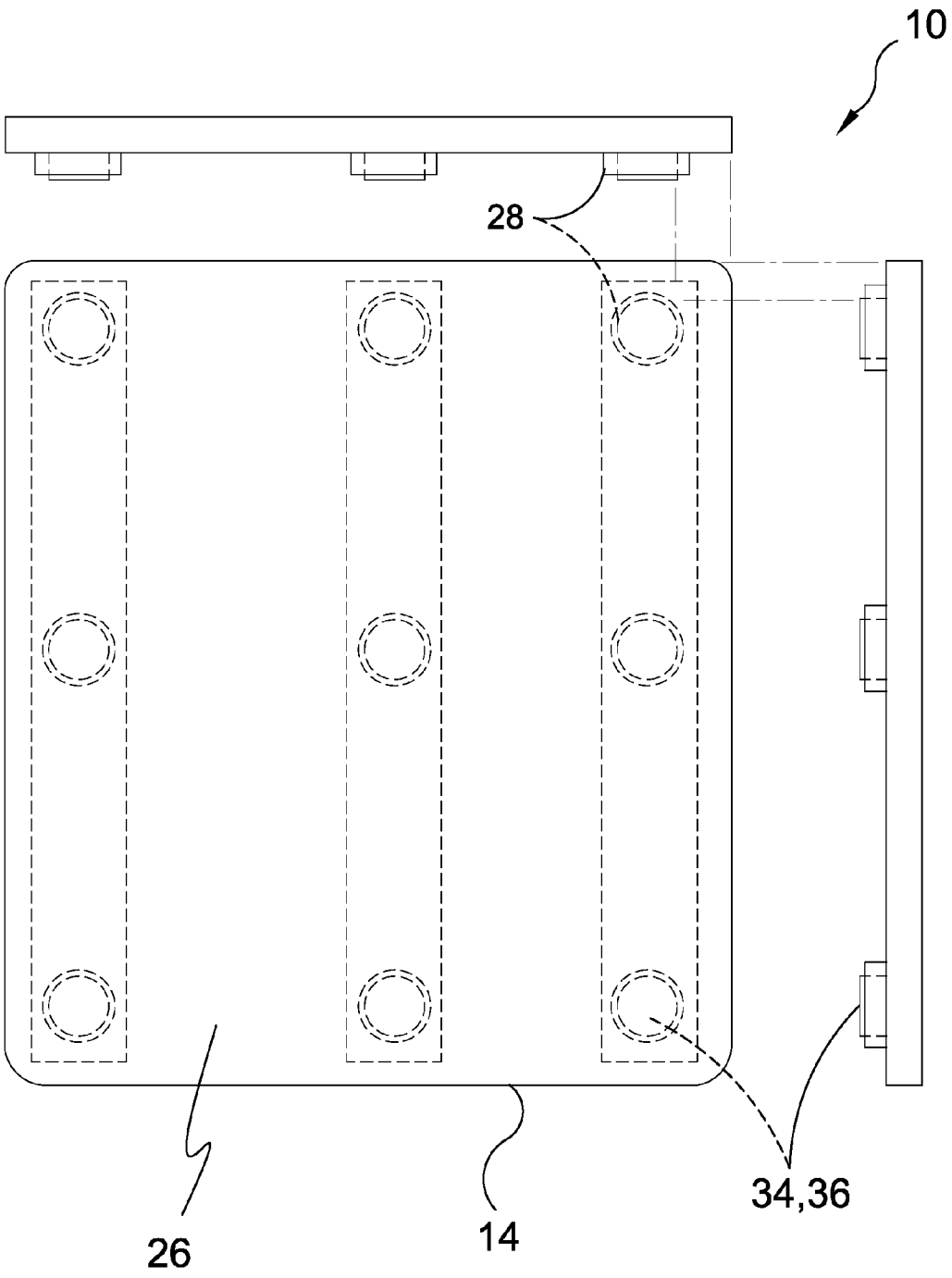
FIG. 8 is an illustrative view of an additional type of fastener employed to attach the ballistic resistant material to a user selected carriable article.

FIG. 8 is an illustrative view of an additional type of fastener 28 employed to attach the ballistic resistant material 26 to a user selected carriable article 14. The method of the present invention 10 provides for attachment fasteners 28 positioned between the article 14 to be lined and the ballistic resistant material 26 such as double back tape, VELCRO®, buttons 34, snaps 36 and glue. The article 14 to be lined including backpack, attaché case, purse and carry-on luggage.

Figure 9:
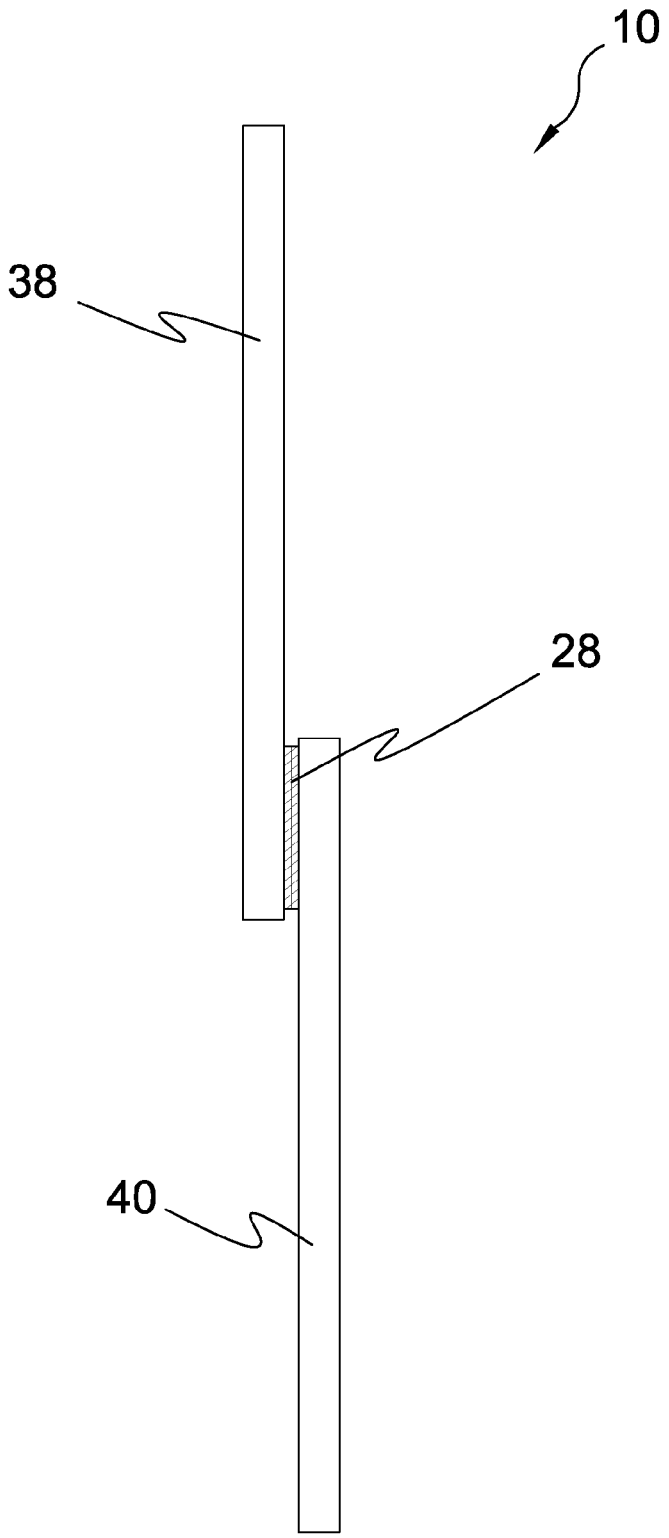
FIG. 9 is a side view of a fastener joining sheets of ballistic resistant material.

FIG. 9 is a side view of a fastener joining sheets of ballistic resistant material. The present invention 10 is a method of producing a ballistic resistant article comprising an article to be lined with a contourable ballistic material. Shown is a first ballistic resistant sheet 38 secured to a second ballistic sheet 40 with a fastener element 28.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A ballistic resistant case comprising:

said ballistic case having first and second mating sections, hinged along one edge and latched at an opposite edge, and forming an interior space and appearing as a piece of carry-on luggage;

a pair of partially but not fully overlapping sheets of bullet proof material;

said first mating section having an inner wall on which is mounted parallel strips of hook or loop material, said partially overlapping sheets of bullet proof material having mating hook or loop material for releasably securing said partially overlapping sheets of bullet proof material within said ballistic case, said two overlapping sheets of bullet proof material thereby sized to fit said ballistic case;

said overlapping portions of said sheets of bullet proof material having a hook and loop fastener for holding the sheets together; and when latched closed, with said sheets of ballistic material being deployed in said ballistic case, said ballistic case appearing as a piece of carry-on luggage, said ballistic case being ready to be used in defense of said user when exposed to a threat.

2. The ballistic case of claim 1, wherein the first mating section has a handle for carrying the case.

3. The ballistic case of claim 2, wherein the sheets of bullet proof material are made from an aramid fiber.

* * * * *